US006441347B1

(12) United States Patent
Wu

(10) Patent No.: US 6,441,347 B1
(45) Date of Patent: Aug. 27, 2002

(54) VAPORIZATION APPARATUS

(76) Inventor: Lambert Wu, No. 78-19, Chung Shan Rd., Pali Hsiang, Taipei Hsien (TW)

( * ) Notice: Subject to any disclaimer, the term of this patent is extended or adjusted under 35 U.S.C. 154(b) by 0 days.

(21) Appl. No.: 09/885,017

(22) Filed: Jun. 21, 2001

(51) Int. Cl.[7] ..... A61H 33/12; F22B 1/28
(52) U.S. Cl. ..... 219/438; 219/439; 219/530
(58) Field of Search ..... 219/438, 401, 219/430, 436, 439, 530, 540; 392/394, 403

(56) References Cited

U.S. PATENT DOCUMENTS 4,724,824 A * 2/1988 McCoy et al. ..... 219/401
5,158,755 A * 10/1992 Higgins et al. ..... 219/540
5,616,115 A * 4/1997 Gloyd et al. ..... 600/22
5,782,165 A * 7/1998 Glenboski et al. ..... 219/438
5,878,190 A * 3/1999 Gloyd et al. ..... 600/22

* cited by examiner

*Primary Examiner*—Joseph Pelham
(74) *Attorney, Agent, or Firm*—Rabin & Berdo, P.C.

(57) ABSTRACT

A vaporization apparatus comprises a cover, a base, and a heating pipe. The base is arranged below the cover and assembled integrally with the cover. The base has an accommodation space therein and a heat-conducting fin plate is provided in the accommodation space. The heat-conducting fin plate has a bottom side connected to a bottom side of the base and the heating pipe is arranged below the base. The heating pipe is completely or partially overlapped with the bottom side of the heat-conducting fin plate. The heat energy generated by the heating pipe can be concentrated to the heat-conducting fin plate and water in the accommodation space can be rapidly heated.

8 Claims, 8 Drawing Sheets

VAPORIZATION APPARATUS

FIELD OF THE INVENTION

The present invention relates to a vaporization apparatus, especially to a vaporization apparatus, wherein the heat energy can be directly transmitted from bottom of the base to the bottom of the heat-conducting fin plate, thus confining thermal energy.

BACKGROUND OF THE INVENTION

The prior art vapor generating apparatus is generally a heating tray within which water is deposited and heated. The water therein is boiled to vapor and used to sterilization.

As shown in FIGS. 1 and 2, a prior art vapor generating apparatus is composed of a base 1 a made of material with good thermal conductivity, an accommodation space 10*a* within the base 1*a* and a U-shaped heating pipe 11*a* arranged below the base 1*a*. The accommodation space 10*a* contains a plurality of thermal-conductive fin plates 12*a*, which facilitate the boiling of water in the accommodation space 10*a*. When using the vapor generating apparatus, water is put into the accommodation space 10*a* and then the heating pipe 11*a* is powered for heating. The temperature of the heating pipe 11*a* is raised and the heat generated by the heating pipe 11*a* is conducted to the sidewall 14*a* and the fin plates 12*a* through the bottom portion 13*a* of the base 1*a*. The water in the accommodation space 10*a* is heated to vaporization and the vapor can be used for sterilization.

However, the heat conducting medium provided by the bottom portion 13*a* and the sidewall 14*a* is not sufficient and the effect of the fin plate 12*a* is important. In prior art vapor generating apparatus, the heating pipe 11*a* is provided below the base 1*a* and the fin plate 12*a* is heated only after the thermal energy is transmitted from the bottom portion 13*a* through the base 1*a*. The effect of the fin plate 12*a* is influenced.

SUMMARY OF THE INVENTION

It is the first object of the present invention to provide a vaporization apparatus, wherein a heating pipe is completely or partially overlapped with the bottom side of the heat-conducting fin plate and the heat energy can be directly transmitted from bottom of the base to the bottom of the heat-conducting fin plate, thus confining thermal energy.

It is the first object of the present invention to provide a vaporization apparatus, wherein the contact area between a heating pipe and a base is increased.

To achieve the first object, the present invention provides a vaporization apparatus comprising a cover, a base, and a heating pipe. The base is arranged below the cover and assembled integrally with the cover. The base has an accommodation space therein and a heat-conducting fin plate is provided in the accommodation space. The heat-conducting fin plate has a bottom side connected to a bottom side of the base and the heating pipe is arranged below the base. The heating pipe is completely or partially overlapped with the bottom side of the heat-conducting fin plate. The heat energy generated by the heating pipe can be concentrated to the heat-conducting fin plate and water in the accommodation space can be rapidly heated.

To achieve the first object, the present invention provides a vaporization apparatus wherein the base thereof has a dent corresponding to the heat-conducting fin plate and the heating pipe is received within the dent.

The various objects and advantages of the present invention will be more readily understood from the following detailed description when read in conjunction with the appended drawing, in which:

DETAILED DESCRIPTION OF THE INVENTION

Figure 1:
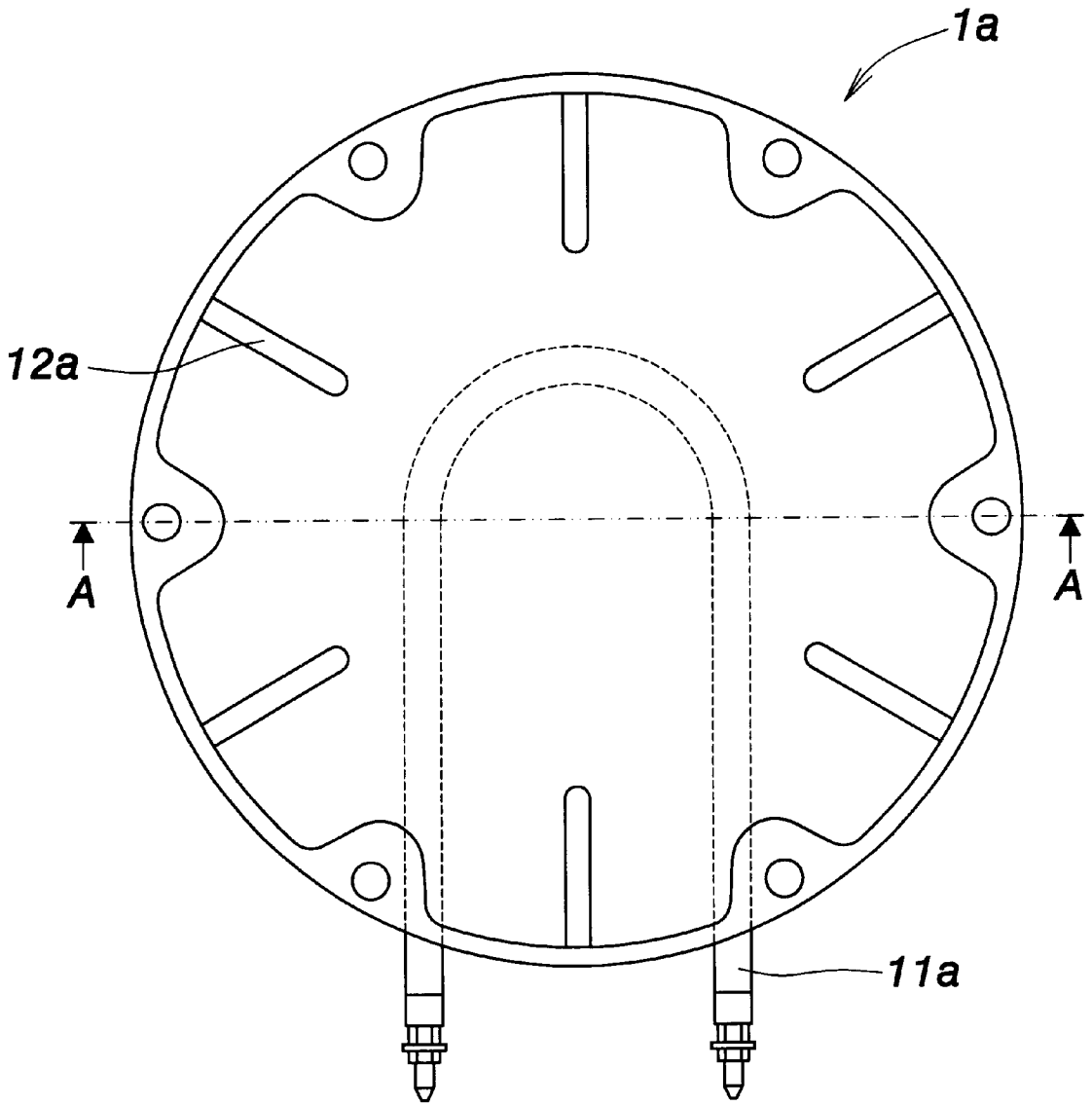
FIG. 1 PRIOR ART
FIG. 1 shows the top view of prior art vaporization apparatus.
Figure 2:
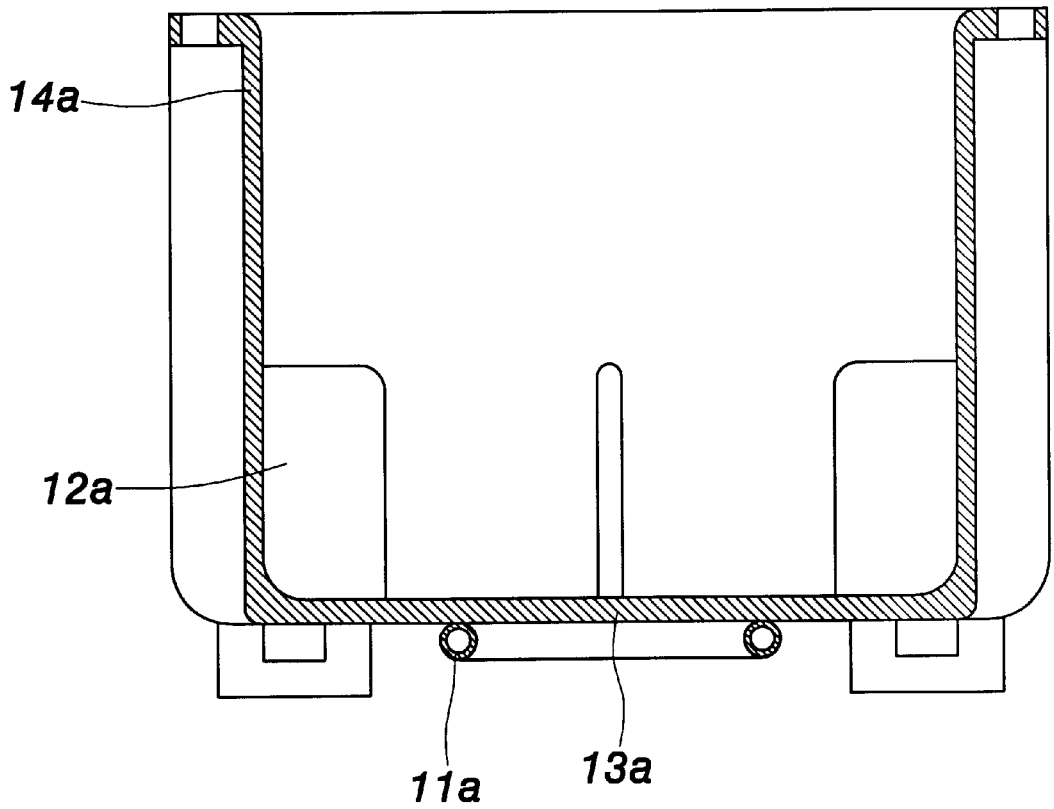
FIG. 2 PRIOR ART
FIG. 2 is a sectional view along line A—A in FIG. 1.
Figure 3:
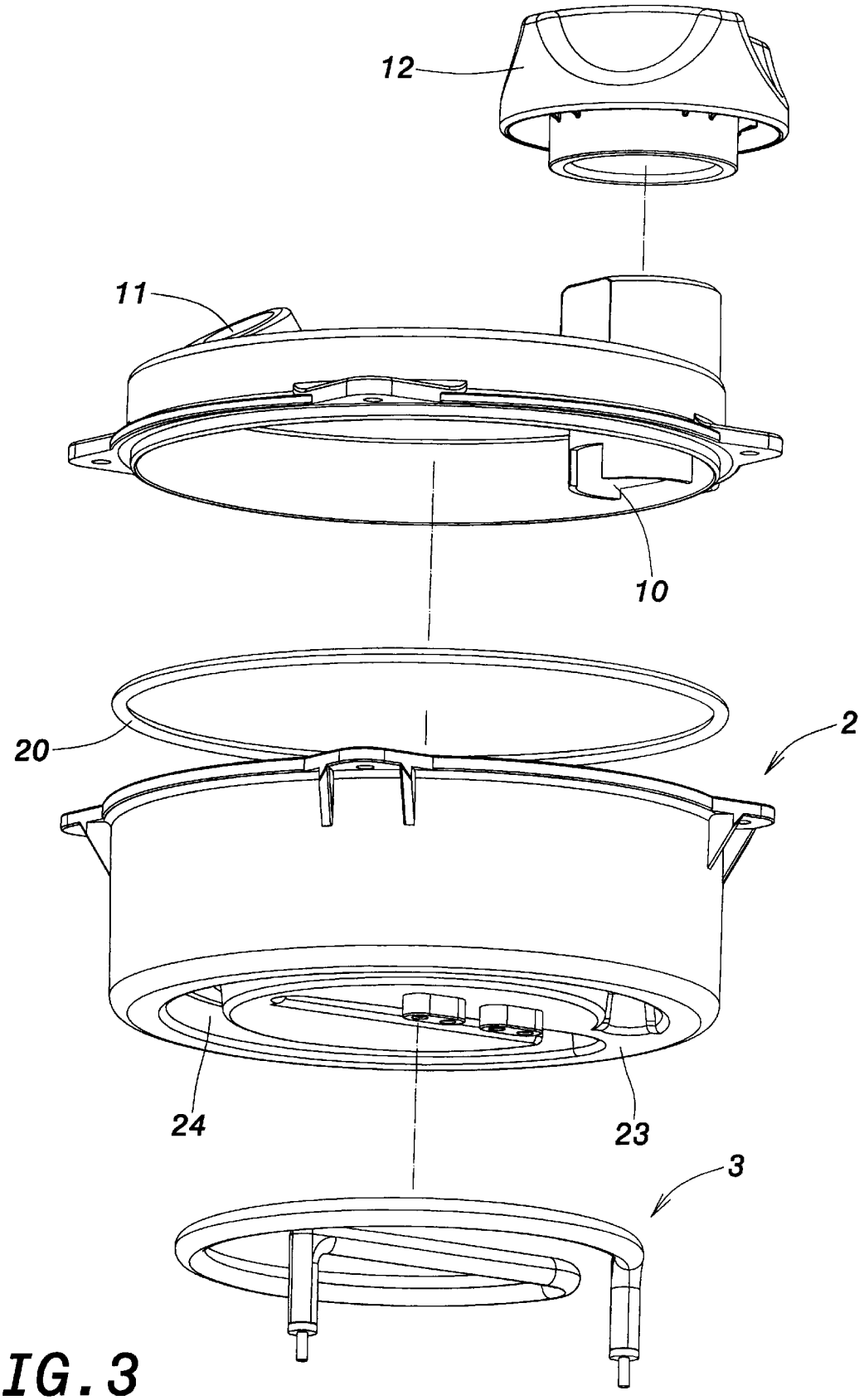
FIG. 3 shows the exploded view of the present invention.
Figure 4:
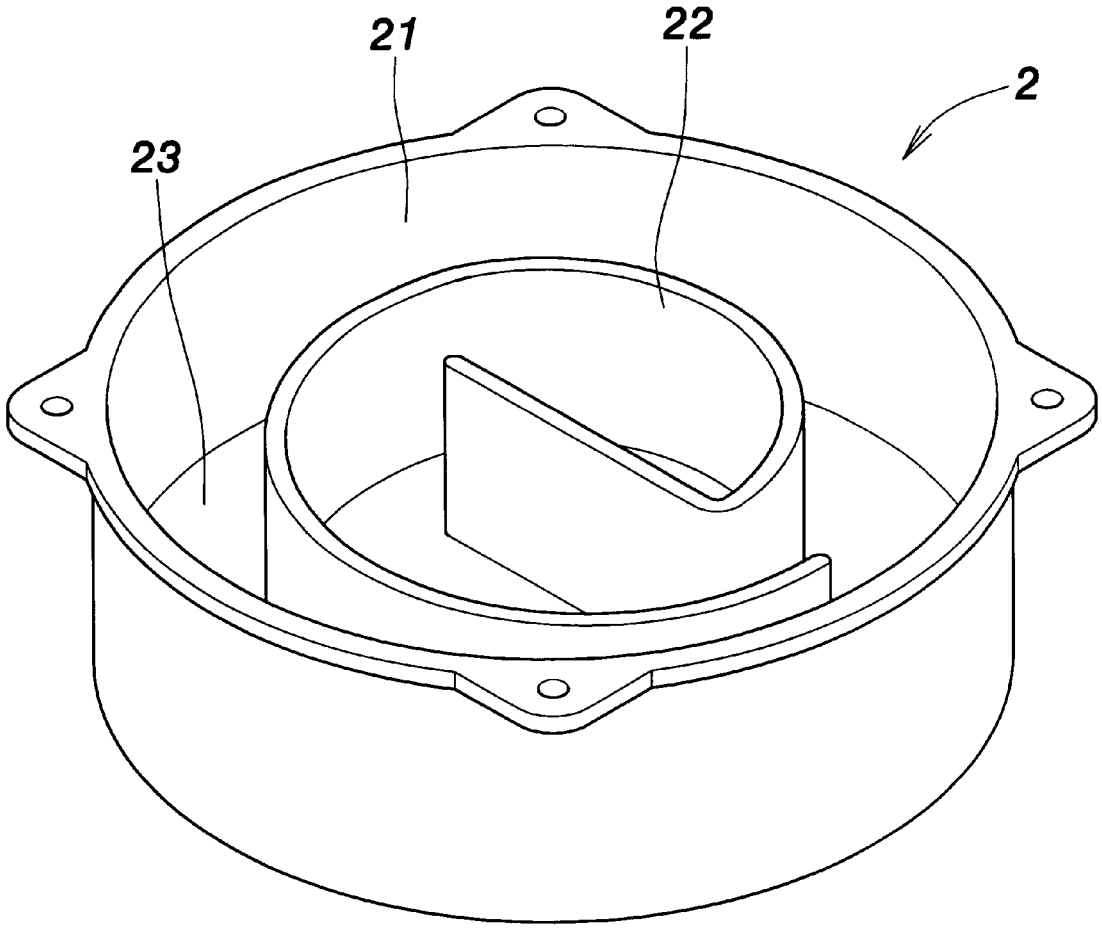
FIG. 4 shows the perspective view of the present invention.
Figure 5:
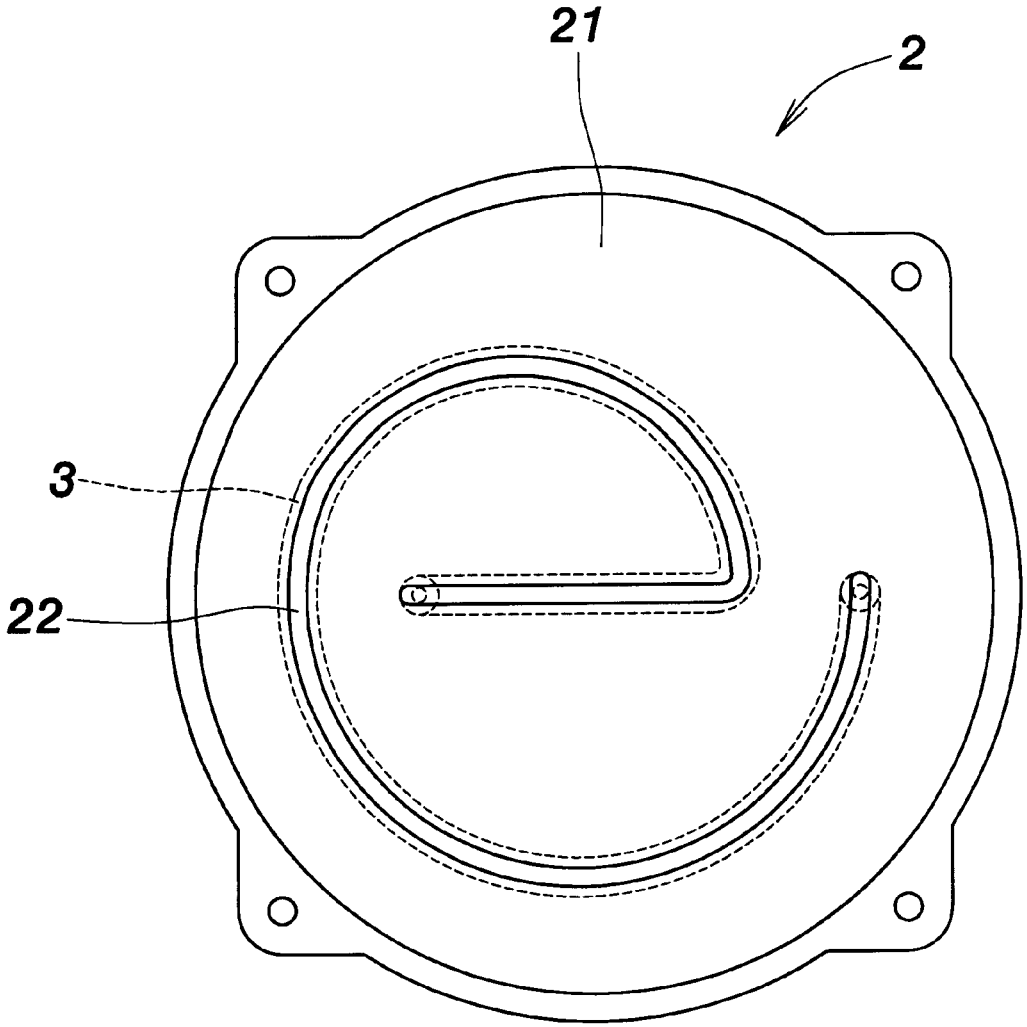
FIG. 5 shows the top view of the present invention.

With reference now to FIGS. 3, 4 and 5, the present invention is intended to provide a vaporization apparatus. The vaporization apparatus comprises a cover 1, a base 2 and a heating pipe 3. The cover 1 has a water inlet 10 and a vapor outlet 11. The water inlet 10 is sealed by a threaded lid 12 after sufficient water is injected into the vaporization apparatus. The vapor outlet 11 can be mounted with a nozzle 13 as shown in FIG. 6 to spay vapor, or connected to a duct (not shown) to guide the vapor out.

The base 2 is made of material with good thermal conductivity and arranged below the cover 1 and assembled integrally with the cover 1. Moreover, a leakage proof washer 20 is arranged between the cover 1 and the base 2 to ensure that the vapor generated by the vaporization apparatus can only be emitted through the vapor outlet 11. The base 2 contains an accommodation space 21 for storing water and the accommodation space 21 contains a heat-conducting fin plate 22. The heat-conducting fin plate 22 is bent to have a cross sectional shape of letter "e" and the bottom of the heat-conducting fin plate 22 is connected to the bottom portion 23 of the base 2.

The heating pipe 3 is arranged below the base 2 and has a cross sectional shape of letter "e" in accordance with the shape of the heat-conducting fin plate 22. Therefore, the cross section of the heating pipe 3 is completely overlapped with the cross section of the heat-conducting fin plate 22. In other word, the heat can be directly conducted to the heat-conducting fin plate 22 through the base 2 due to the complete overlap between the cross section of the heating pipe 3 and the heat-conducting fin plate 22. The water in the accommodation space 21 can be quickly heated to vapor.

Figure 6:
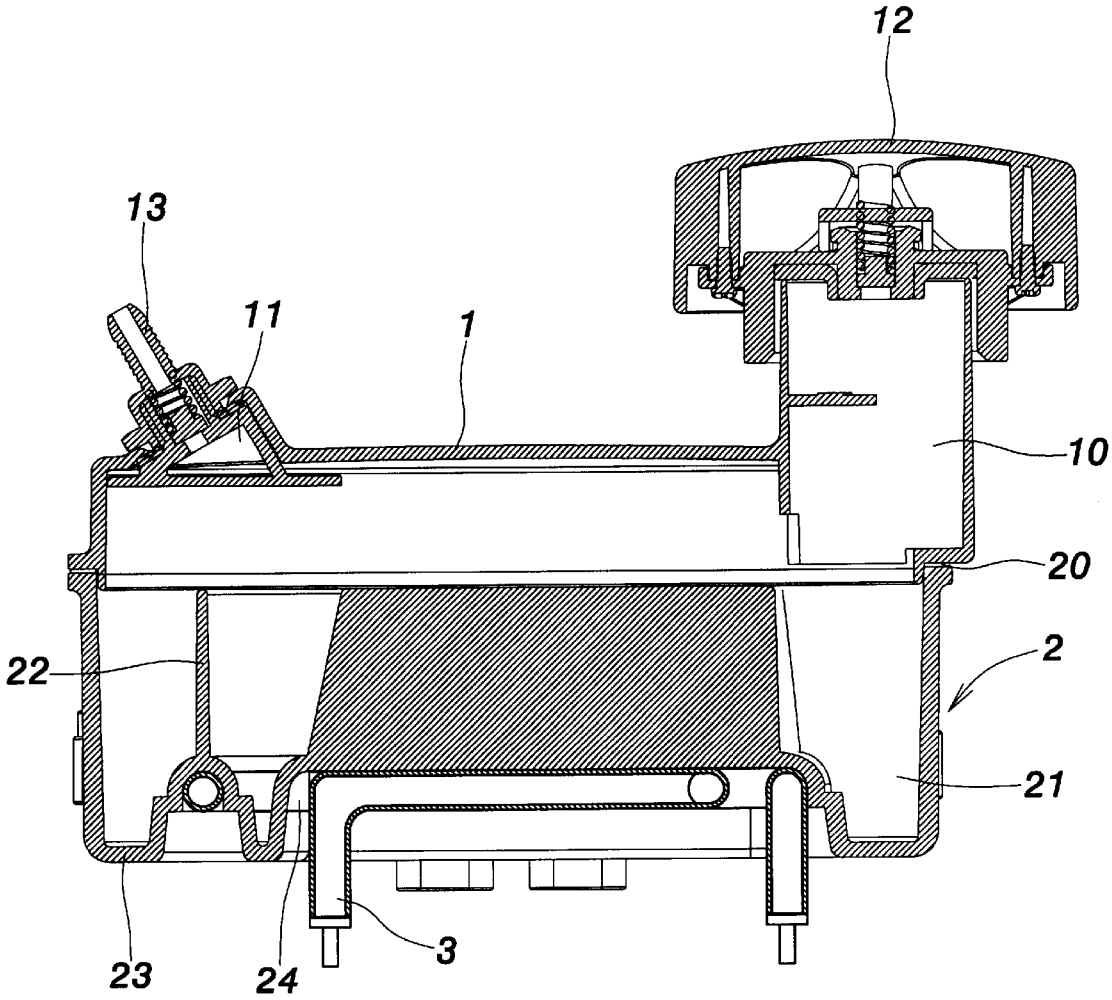
FIG. 6 shows the sectional view of the present invention.

Moreover, as shown in FIGS. 3 and 6, a dent 24 with shape corresponding to that of the heating pipe 3 is provided on bottom of the base 2 to further increase the contact area between the base 2 and the heating pipe 3. The dent 24 also has shape corresponding to that of the heat-conducting fin plate 22 and the heating pipe 3 is placed within the dent 24. Therefore, the contact area of the heating pipe 3 is increased and the heating pipe 3 is closer to the accommodation space 21.

Figure 7:
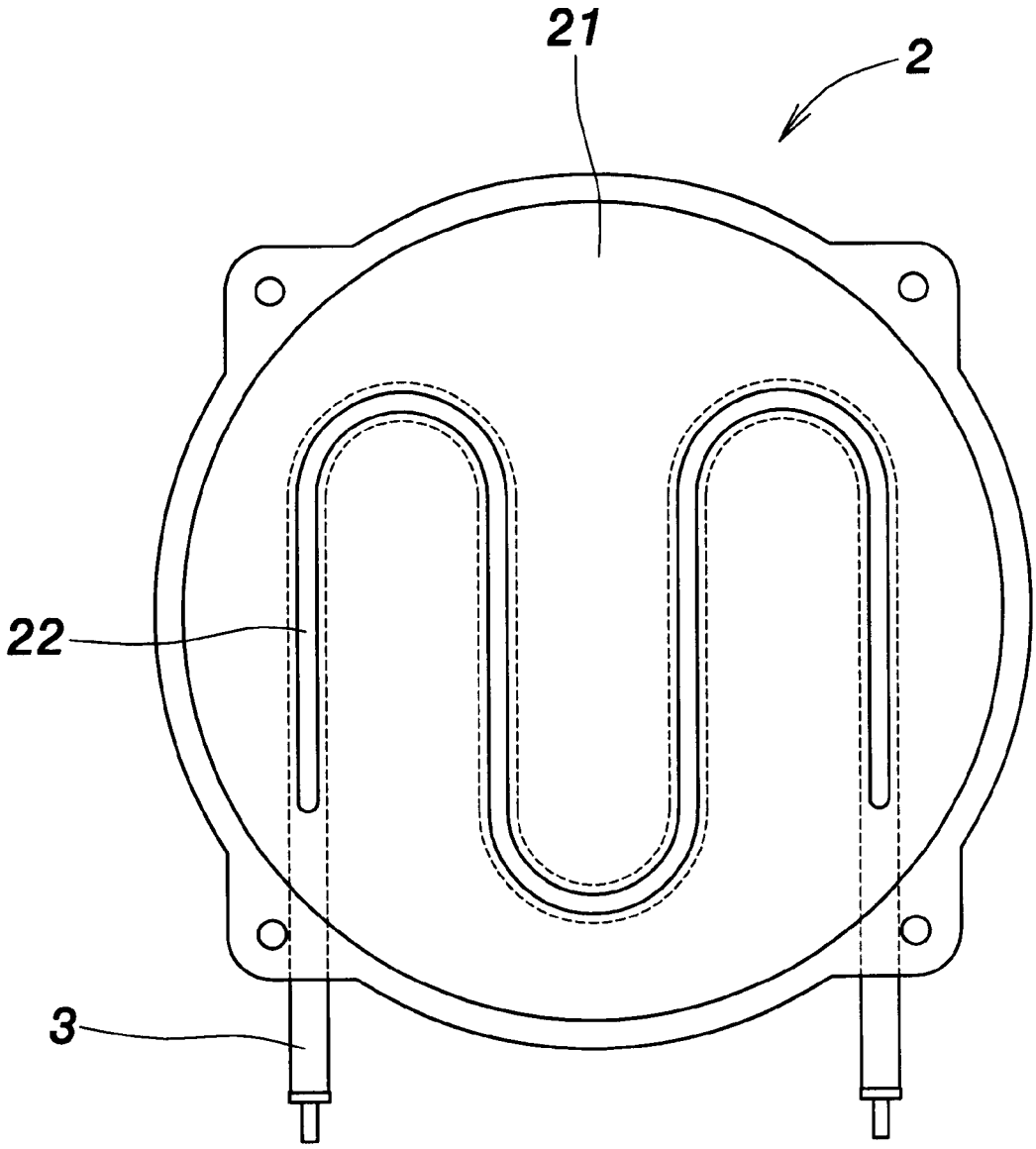
FIG. 7 shows the top view of another preferred embodiment of the present invention.

FIG. 7 shows the top view of another preferred embodiment of the present invention. The cross sectional shape of the heat-conducting fin plate 22 can be adapted according to the geometry of the vaporization apparatus, for example, the cross sectional of letter "M". The heating pipe 3 should have a cross sectional shape in accordance with the shape of the heat-conducting fin plate 22.

Figure 8:
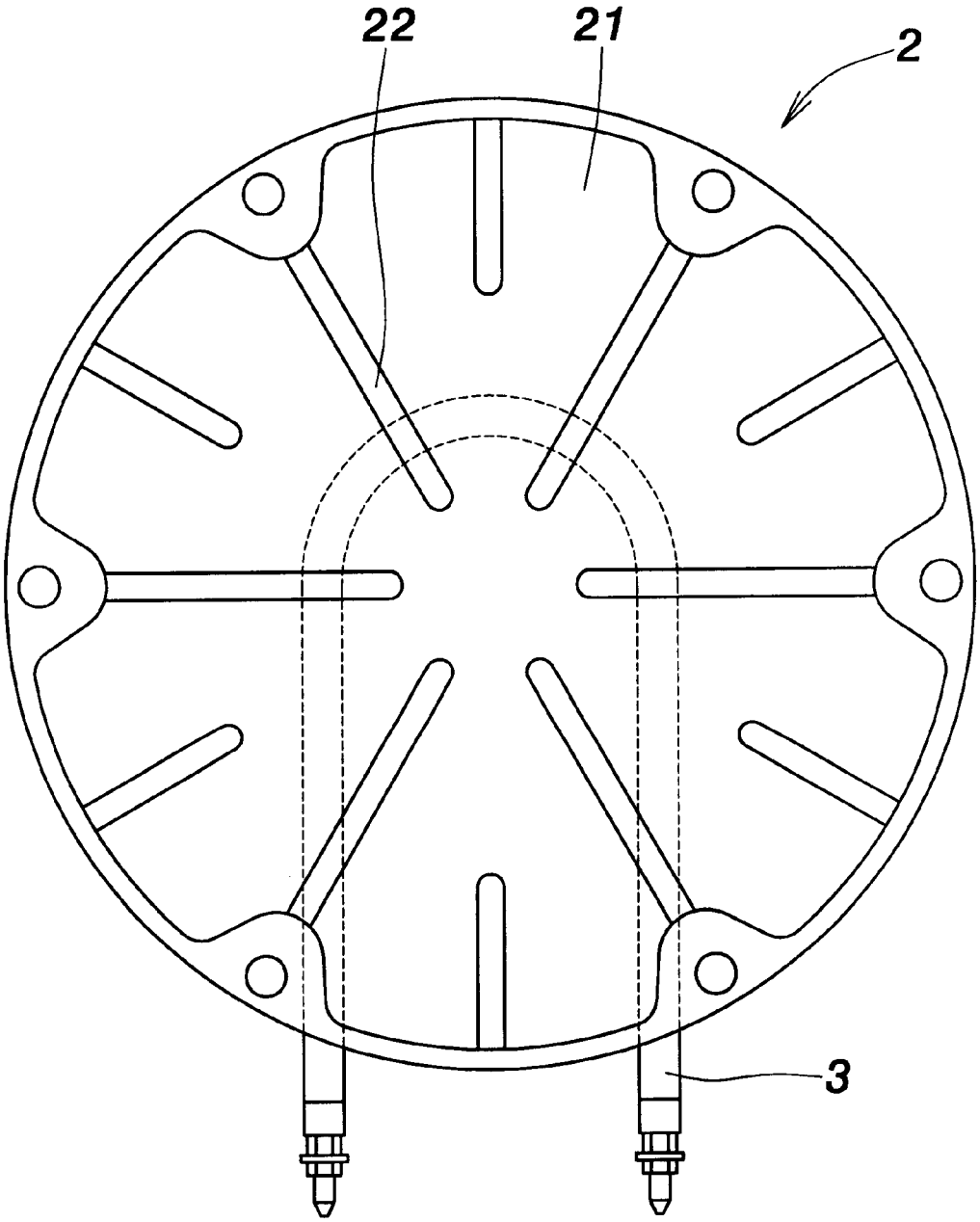
FIG. 8 shows the top view of still another preferred embodiment of the present invention.

FIG. 8 shows the top view of still another preferred embodiment of the present invention. As shown in this figure, the heating pipe 3 has only partial overlap with the bottom of the heat-conducting fin plate 22. The heat of the heating pipe 3 can still transmit to the overlap portion between the cross sectional shape of the heating pipe 3 and the heat-conducting fin plate 22 through the bottom portion 23 of the base 2. In other word, the present invention is not limited to the structure of complete overlap between the cross sectional shape of the heating pipe 3 and the heat-conducting fin plate 22.

Although the present invention has been described with reference to the preferred embodiment thereof, it will be understood that the invention is not limited to the details thereof Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A vaporization apparatus, comprising a cover having a water inlet and a vapor outlet; a base arranged below the cover and having an accommodation space therein, a heat-conducting fin plate being provided in the accommodation space, the heat-conducting fin plate having a bottom side connected to a bottom side of the base; and a heating pipe arranged below the base and being completely or partially overlapped with the bottom side of the heat-conducting fin plate;

the heating pipe generating a heat energy transmitted to the bottom side of the heat-conducting fin plate through the bottom side of the heat-conducting fin plate whereby the heat energy generated by the heating pipe can be concentrated to the heat-conducting fin plate and water in the accommodation space can be rapidly heated, and wherein the heat-conducting fin plate has a cross sectional shape of English letter "e" or "M".

2. The vaporization apparatus as in claim 1, further comprising a threaded lid, which can be used to seal the water inlet.

3. The vaporization apparatus as in claim 1, wherein the vapor outlet is connected to a nozzle or a duct.

4. The vaporization apparatus as in claim 1, further comprising a leakage proof washer between the cover and the base.

5. A vaporization apparatus, comprising:

a cover having a water inlet and a vapor outlet;

a base arranged below the cover and having an accommodation space therein, a heat-conducting fin plate being provided in the accommodation space, the heat-conducting fin plate having a bottom side connected to a bottom side of the base; and a heating pipe arranged below the base and being completely or partially overlapped with the bottom side of the heat-conducting fin plate; the heating pipe generating a heat energy transmitted to the bottom side of the heat-conducting fin plate through the bottom side of the heat-conducting fin plate whereby the heat energy generated by the heating pipe can be concentrated to the heat-conducting fin plate and water in the accommodation space can be rapidly heated, and wherein the base has a dent corresponding to the heat-conducting fin plate and the heating pipe is received within the dent.

6. The vaporization apparatus as in claim 5, further comprising a threaded lid, which can be used to seal the water inlet.

7. The vaporization apparatus as in claim 5, wherein the vapor outlet is connected to a nozzle or a duct.

8. The vaporization apparatus as in claim 5, further comprising a leakage proof washer between the cover and the base.

* * * * *